US006108901A

United States Patent [19]

Kossor

[11] Patent Number: 6,108,901

[45] Date of Patent: Aug. 29, 2000

[54] TOOL FOR IMPLEMENTING NON-DESTRUCTIVE SEPARATION OF ELECTRICAL COMPONENTS

[75] Inventor: Michael G. Kossor, Kenilworth, N.J.

[73] Assignee: Lucent Technologies Inc., Murray Hill, N.J.

[21] Appl. No.: 08/991,520

[22] Filed: Dec. 16, 1997

[51] Int. Cl.[7] ..... H01R 43/04

[52] U.S. Cl. ..... 29/842; 29/764; 29/762

[58] Field of Search ..... 29/762, 764

[56] References Cited

U.S. PATENT DOCUMENTS 5,046,237 9/1991 Conforti et al. .
5,152,052 10/1992 Rantala et al. .

*Primary Examiner*—Lee Young
*Assistant Examiner*—Sean Smith
*Attorney, Agent, or Firm*—Law Office of Leo Zucker

[57] ABSTRACT

A tool for implementing a non-destructive separation of electrical components from one another. The tool has a handle part and a pair of legs extending from the handle part with a certain spacing between distal ends of the legs. The leg end spacing corresponds to a distance between a pair of holes in one electrical component, e.g., holes in mounting flanges of an electrical device whose terminals are soldered on a wire board, or holes in a wire board that is joined to another wire board via mating pin connectors soldered on the boards. The leg ends are constructed to engage the one component once the leg ends are inserted in corresponding holes in the one component, and the handle part is arranged to be manipulated to separate the first component from the second component when the leg ends engage the one component.

1 Claim, 3 Drawing Sheets

TOOL FOR IMPLEMENTING NON-DESTRUCTIVE SEPARATION OF ELECTRICAL COMPONENTS

BACKGROUND OF THE INVENTION

1. Field of the Invention

The present invention relates to tools for handling electrical components, and particularly to a tool for separating electrical components from one another in a non-destructive manner.

2. Discussion of the Known Art

It is sometimes necessary to separate and to remove an electrical component from a printed wire board in order to test the component for proper operation. A problem arises when terminals of the component are soldered on the wire board. This makes it difficult to remove the component without cutting off the terminals entirely or overheating the component while de-soldering the terminals from the board.

Further, it is common to interconnect and to join printed wire boards to one another via mating pin connectors, wherein a pin connector on one board is aligned with a mating socket connector on the other board, and the board connectors are joined to one another. Printed wire boards thus joined are then usually mounted as a unit on a common chassis frame, and separation of the joined boards later for repair purposes presents a special challenge. Attempting to pry the boards apart at their edges near the chassis frame usually fails to transmit a sufficient disconnecting force in the region of the mated connectors, and, further, is not a desirable technique since damage can be inflicted to printed traces or components near the edge of a board where a pry bar is applied. Damage may also occur to electrical components or solder joints at any region of the board which flexes or bends when its edges are pried relative to the chassis frame.

U.S. Pat. No. 5,046,2:37 (Sep. 10, 1991) discloses an extractor tool, for removing a circuit module from a connector which is latched to the circuit module. The tool has a pair of legs with tapered edge surfaces, for springing latches on the connector apart to release the module. U.S. Pat. No. 5,152,052 (Oct. 6, 1992) relates to a printed circuit board removal tool for removing a memory board from an underlying processor board. The tool has inner and outer U-shaped frame structures, which bear against surfaces of the boards and separate them in response to operation of upper and lower tool handle members.

There remains a need for a tool that can be fabricated relatively simply and inexpensively but which nonetheless works reliably to separate electrical components in a non-destructive manner, especially when the components are soldered on a printed wire board, or when the components are themselves printed wire boards that are joined to one another via mating pin connectors.

SUMMARY OF THE INVENTION

According to the invention, a tool for implementing a non-destructive separation of connected electrical components from one another, comprises a handle part, and a pair of legs extending from the handle part with a certain spacing between distal ends of the legs. The distal leg end spacing corresponds to a distance between a pair of holes in one electrical component that is joined to another electrical component, and the leg ends are constructed and arranged to engage the one component once the leg ends are inserted in corresponding holes in the one component. The handle part is arranged to be manipulated to separate the one component from the other when the leg ends of the tool engage the one component.

For a better understanding of the present invention, reference is made to the following description taken in conjunction with the accompanying drawings, and the scope of the invention will be pointed out in the appended claims.

DETAILED DESCRIPTION OF THE INVENTION

Figure 1:
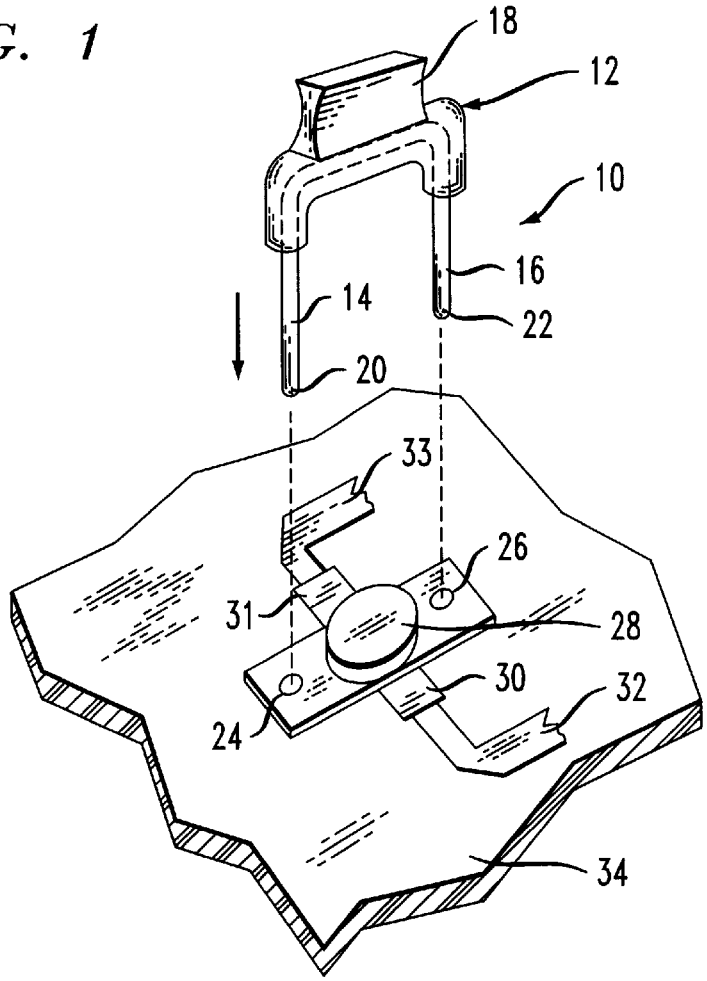
FIG. 1 is a perspective view of a first embodiment of a tool according to the invention, ready to engage a component for separation and removal from a printed wire board.

FIG. 1 is a view of a first embodiment of a tool 10 according to the invention. The tool 10 is generally "U"-shaped, with a handle part 12 and a pair of elongate legs 14, 16 that extend from opposite ends of the handle part 12. The legs 14, 16 may be formed from a single piece of stainless steel, brass, phosphor bronze or equivalent rod stock which preferably has good thermal conductivity, and which is bent into a "U" shape. Handle part 12 preferably includes a finger grip 18 made from a heat insulating plastics or equivalent material which is molded over the rod stock forming the legs 14, 16. The grip 18 extends between proximal ends of the tool legs 14, 16 and may envelop upper portions of the legs so that the grip 18 can not swivel on the rod stock with respect to the legs.

The tool legs 14, 16 have corresponding distal leg ends 20, 22. The distal leg ends 20, 22 are spaced apart from one another by a distance that corresponds to a distance between a pair of mounting holes 24, 26 in mounting flanges of an electrical component or device 28 (e.g., a RF transistor) having a pair of terminals 30, 31 that are soldered to corresponding wire traces 32, 33 on a printed wire board 34. Ordinarily, to de-solder the device 28 from the board 34 for purposes of testing the device 28 alone, a thin blade is urged beneath each terminal, one terminal at a time, while the terminal is heated to melt its solder joint with a corresponding wire trace 32, 33. The terminal is then bent with the blade away from the board so as to prevent the terminal from re-adhering to the molten solder. Unsoldering the device terminals one at a time as described above often results in irreparable damage to the device 28, because of excessive heating, breaking of the device terminals, or both. Also, damage is often caused to the wire board 34 during such a removal process. Attempts to pry the device 28 from the board 34 by jamming screwdriver blades into the mounting holes 24, 26 and manipulating the screwdrivers while heating the device terminals 30, 31, also causes damage to the device.

According to the invention, the distal leg ends 20, 22 of the tool 10 are constructed and arranged to engage the device 28 once the leg ends are inserted in corresponding mounting holes 24, 26 in the device. In the embodiment of FIG. 1, the tool leg ends 20, 22 are set to be spaced at a distance substantially equal to the spacing or pitch of the mounting holes 24, 26 in the device 28. The leg ends 20, 22 have such a diameter or cross-section as to be able to enter the mounting holes 24, 26 in the device flanges freely without damaging the hole walls, and to come into engagement or contact with the hole walls when the tool grip 18 is swiveled no more than about 10 degrees from a direction normal to the flanges. Typical hole depths, i.e., device flange thicknesses, range from about 0.050 to about 0.070 inches.

Figure 2:
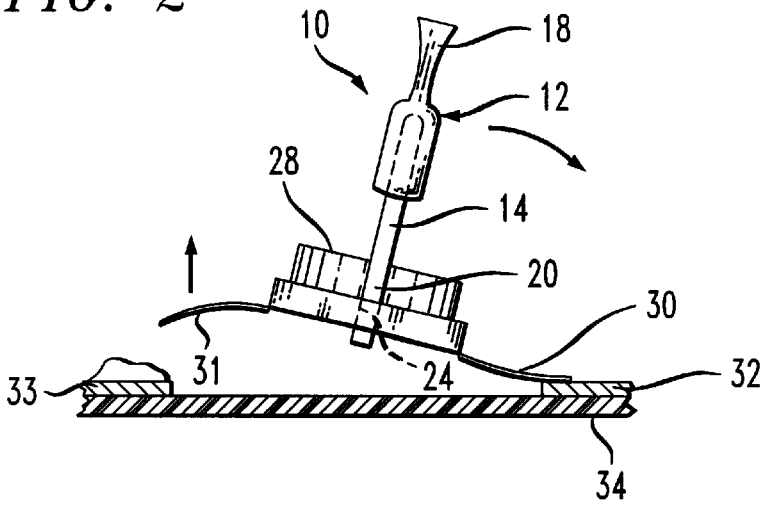
FIG. 2 is an enlarged, side elevation view showing the tool engaged with the component at an initial phase of removal from the wire board.
Figure 3:
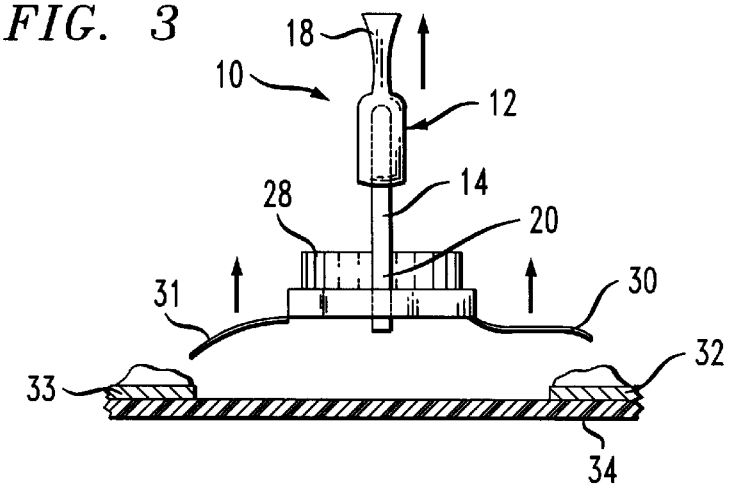
FIG. 3 is a view as in FIG. 2, with the component at a final phase of removal.

FIGS. 2 and 3 show how the device 28 is safely and nondestructively removed from the board 34 using the tool 10. With the leg ends 20, 22 fully entering the device holes 24, 26, a solder joint between the device terminal 31 and board trace 33 at the left side of the device in FIG. 2, is heated. As the solder joint melts the tool grip 18 is urged to the right, and the left-side terminal 31 separates from the corresponding wire trace 33. The right side terminal 30 is not over-stressed while the device 28 is being swung by the tool 10 enough to separate the terminal 31 from its solder joint with the wire trace 33.

Next, a solder joint: between the device terminal 30 and the board trace 32 at the right side of the device in FIG. 2, is melted and the tool grip 18 is; urged upward as in FIG. 3. The terminal 30 separates from adhesion with its molten solder joint. The terminal 30 is not over-stressed during this step up to the point where the entire device 28 fully separates from the board 34 with the aid of the tool 10.

Figure 4:
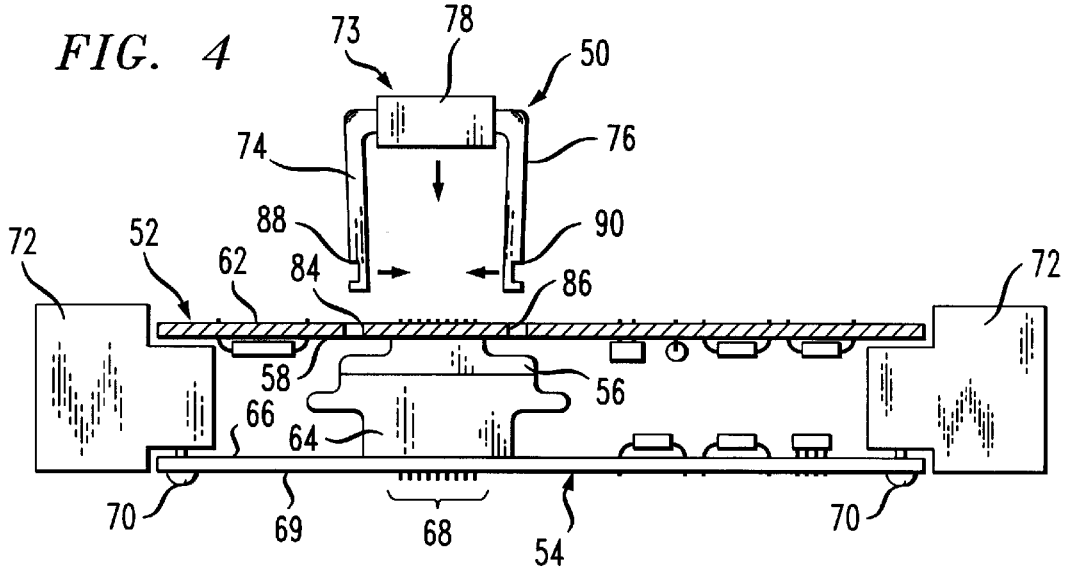
FIG. 4 is an elevation view of a second embodiment of a tool according to the invention, about to engage a first wire board for separation from a second wire board.

FIG. 4 shows a second embodiment of a tool 50 according to the invention, about to engage a first wire board 52 for separation from a second wire board 54. The first board 52 has a socket connector 56 mounted against a bottom side 58 of the board 52 as viewed in FIG. 4. A series of pin terminals 60 pass through corresponding openings in the board 52 and are soldered to wire traces on a top side 62 of the board 52.

The second wire board 54 has a pin connector 64 mounted on a top side 66 of the board 54 as viewed in FIG. 4. A series of pin terminals 68 pass through corresponding openings in the board 54 and are soldered to wire traces on a bottom side 69 of the board 54. The first board 52 is electrically and mechanically joined with the second board 54 by mating the connectors 56, 64 to one another as in FIG. 4. Preferably, before urging the connectors 56, 64 together, one of the boards (e.g., the second board 54) is mounted by fasteners 70 at its perimeter on an inside recessed edge of a chassis frame 72. The connectors 56, 64 are joined until the perimeter of the other board (e.g., the first board 52) is flush against another inside recessed edge of the chassis frame 72, and the board 52 is also fastened to the chassis frame 72 via fasteners (not shown) along its perimeter.

Figure 5:
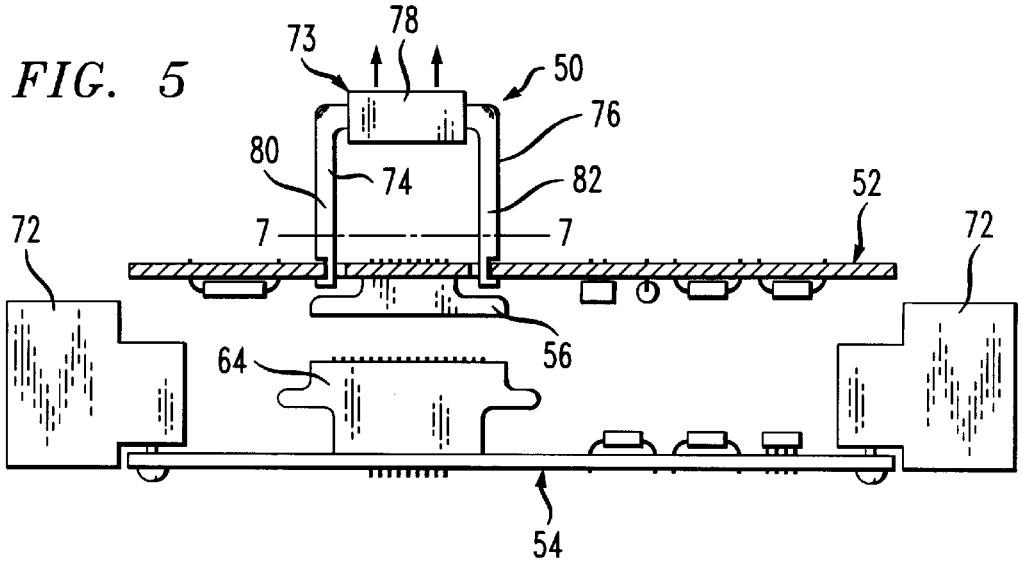
FIG. 5 is a view as in FIG. 4 showing the tool engaged with the first board after the latter is separated from the second board.
Figure 6:
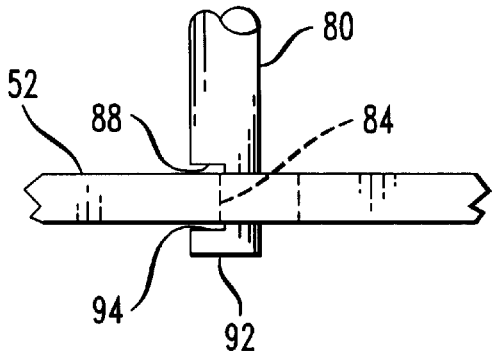
FIG. 6 is an enlarged detail view showing a part of the first board in FIG. 5 engaging a notch in a leg end of the tool.
Figure 7:
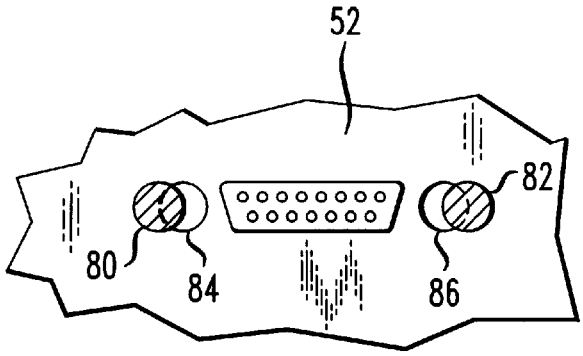
FIG. 7 is an enlarged plan view of part of the first board in FIG. 5, illustrating a relative offset between a leg spacing of the tool and a hole pair spacing on the board.

FIGS. 5–7 illustrate a non-destructive separation of the first board 52 from the second board 54, using the tool 50. As shown in the drawing, the tool 50 is generally "U"-shaped, with a handle part 73 and a pair of elongate legs 74, 76 that extend from opposite ends of the handle part 73. The handle part 73 and the legs 74, 76 may be formed as a unit from a piece of stainless steel, brass, phosphor bronze or equivalent rod stock. Handle part 73 may also have a grip 78 of plastics or equivalent material for user comfort.

The tool legs 74, 76 have corresponding distal leg ends 80, 82. The leg ends 80, 82 are spaced apart from one another by a distance slightly offset with respect to a spacing or pitch of a pair of holes 84, 86 in the first wire board 52. In the illustrated embodiment, the holes 84, 86 are located in the board 52 so as to coincide with parts of the socket connector 56 that are spaced clear of the board bottom side 58 when the connector 56 is mounted on the board 52. Each of the leg ends 80, 82 has an associated notch 88, 90 dimensioned to receive a hole edge part of the first wire board 52 once the leg end passes through a corresponding one of the board holes 84, 86.

Specifically, in the illustrated embodiment, the leg ends 80, 82 are pitched or spaced by a distance slightly wider than the pitch or spacing of the board holes 84, 86. When it becomes necessary to separate the first board 52 from the second board 54, for example, to repair or replace components mounted on the bottom side 58 of the board 52 or the top side 66 of the board 54, the first board 52 is unfastened from the chassis frame 72. The legs 74, 76 of the tool 50 are squeezed toward one another while the leg ends 80, 82 are inserted into corresponding holes 84, 86 in board 52 at either side of the connector pin terminals 60. The diameter or cross-section of the leg ends is preferably slightly smaller (e.g., 10 mils) than the diameter of the board holes 84, 86 such that the leg ends 80, 82 may be inserted easily through the holes while the tool legs are squeezed toward one another.

Once inserted in the board holes 84, 86, the leg ends 80, 82 will tend to expand back to their original pitch once the squeezing force on the tool legs 74, 76 is released. FIGS. 6 and 7 show the left leg end 80 of the tool 50 engaging part of the first wire board 52 in the region of the edge of the board. Specifically, the leg end notch 88 forms a foot 92 that extends over the edge of the hole 84 in the board 52, thus providing a contact area 94 on the board.

FIG. 7 is a plan view of part of the first board 52, showing cross-sections of the leg ends 80, 82 engaged with the board 52. The figure illustrates the widening expansion of the tool leg ends 80, 82 beyond the pitch of the holes 84, 86 in the board 52.

Once the tool 50 engages the first wire board 52, the user exerts an upward force on the tool handle part 73 as seen in FIG. 5, while holding or otherwise bracing the chassis frame 72 steady. The tool 50 acts to pull the socket electrical connector 56 apart from the mating male connector 64, by transmitting a disconnecting pull force to the connector 56 through a relatively small region of the first board 52, to the connector pin terminals 60 which are joined to the board near the board holes 84, 86. Thus, neither of the boards 52, 54 is stressed or otherwise damaged while the tool 50 separates the boards from one another. Printed circuit traces, mounted board components (through hole or surface mount components) and solder joints on both boards remain unharmed during the separation process.

Figure 8:
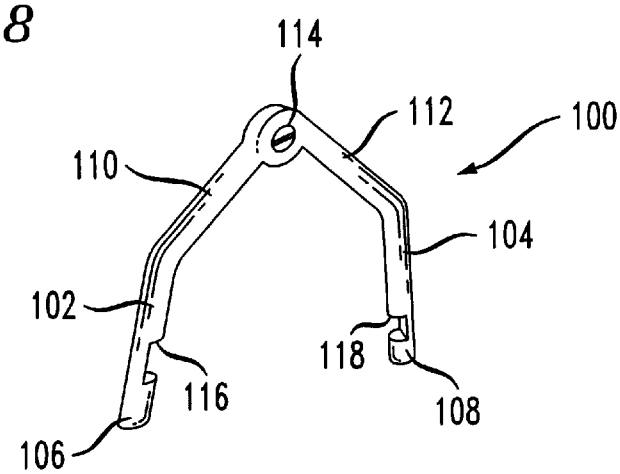
FIG. 8 is a perspective view of a third embodiment of a tool according to the invention.

FIG. 8 is a view of a third embodiment of a tool 100 according to the invention. The tool 100 has a pair of legs 102, 104 with corresponding distal leg ends 106, 108. Upper parts 110, 112 of the tool legs 102, 104 bend toward one another and together form a handle part of the tool when the upper ends of the leg parts 110, 112 are pivoted to one another by a fastener 114. The distal leg ends 106, 108 have notches 116, 118 facing toward one another. To use the tool 100 for separating one wire board from another, the leg ends 106, 108 are inserted in a hole pair in the one board at either side of the board connector. The tool legs 102, 104 are then squeezed together so that the notches 116, 118 engage the board, and the tool 100 is pulled to separate the one board from the other at their associated connectors. If the tool 100 is grasped on the upper ends 110, 112 of its leg parts while pulling on the tool, the distal leg ends 106, 108 will be urged toward one another so as to keep the wire board engaged with the notches 116, 118 in the distal leg ends.

The tools 10, 50 may each be provided in kits of more than one size of a given tool, wherein the tools in each kit have different, fixed leg spacings to accommodate components having different distances or pitches between hole pairs in the components. The tool 100 may be used to engage hole pairs in components over a range of different hole pitches or spacings by allowing the tool legs 102, 104 to pivot relative to one another about the leg end fastener 114.

While the foregoing description represents preferred embodiments of the invention, it will be obvious to those skilled in the art that various changes and modifications may be made without departing from the true spirit and scope of the invention as pointed out by the following claims.

I claim:

1. A tool kit comprising more than one tool each for implementing a non-destructive separation of an electrical component having one or more terminals that are soldered to a wire board, the component having mounting holes that are spaced apart a certain distance from one another, each tool comprising:

a handle part including a grip of a heat insulating material; and a pair of legs extending from the handle part wherein said legs are in the form of thermally conductive rods and distal ends of said legs have cross sections formed to enter the mounting holes in the component and to contact walls of the holes when the handle part is swiveled not more than about ten degrees from a direction normal to the board on which the component is mounted, the spacing between the distal ends of the legs is substantially equal to the distance between two mounting holes in a given component; and the grip of the handle part is constructed and arranged to be manipulated to separate the component from the wire board when the component is desoldered from the wire board;

wherein each of the tools of the tool kit has a different spacing between the distal ends of its legs to accommodate electrical components having correspondingly different distances between mounting holes in the components.

* * * * *